US010814204B2

(12) United States Patent
Ball

(10) Patent No.: US 10,814,204 B2
(45) Date of Patent: Oct. 27, 2020

(54) GOLF ALIGNMENT TRAINING AID

(71) Applicant: Frederick Leslie Ball, Windsor Hills, CA (US)

(72) Inventor: Frederick Leslie Ball, Windsor Hills, CA (US)

( * ) Notice: Subject to any disclaimer, the term of this patent is extended or adjusted under 35 U.S.C. 154(b) by 0 days.

(21) Appl. No.: 16/431,410

(22) Filed: Jun. 4, 2019

(65) Prior Publication Data

US 2019/0366183 A1 Dec. 5, 2019

Related U.S. Application Data

(60) Provisional application No. 62/680,320, filed on Jun. 4, 2018.

(51) Int. Cl.
*A63B 69/36* (2006.01)

(52) U.S. Cl.
CPC ..... *A63B 69/3667* (2013.01)

(58) Field of Classification Search
CPC ..... A63B 2071/0694; A63B 69/3608; A63B 69/3667; A63B 2209/10; A63B 57/207; A63B 57/353; A63B 57/50; A63B 57/0032; A63B 57/203; A63B 69/3676; A63B 57/00; A63B 69/0059
USPC ..... 473/217, 218, 270–273
See application file for complete search history.

(56) References Cited

U.S. PATENT DOCUMENTS 262,594 A * 8/1882 How
3,175,827 A * 3/1965 Livingood ..... A63B 69/3608 473/217
3,556,364 A * 1/1971 Maretka ..... A43B 5/001 224/191
5,246,749 A * 9/1993 Handzlik ..... A43B 23/24 2/245
5,947,832 A * 9/1999 Gagne ..... A63B 69/3667 473/217
6,912,802 B2 * 7/2005 Cooper ..... A43B 5/001 36/1
7,228,649 B2 * 6/2007 Elliott ..... A43B 1/0036 36/114
7,758,438 B1 * 7/2010 Colomberti ..... A63B 69/3608 473/217
9,849,365 B2 * 12/2017 Faucette ..... A63B 69/3667
2004/0237350 A1 * 12/2004 Latham ..... A43B 3/00 36/127
2006/0040757 A1 * 2/2006 Rosselli ..... A63B 69/3608 473/207

* cited by examiner

*Primary Examiner* — Nini F Legesse
(74) *Attorney, Agent, or Firm* — Gottlieb, Rackman, & Reisman, PC

(57) ABSTRACT

A golf directional aid that is attached to each shoe of the two shoes of an individual who is playing golf, to visually assist the individual physically align his/her feet with respect to an intended target (e.g., fairway, green, hole, etc.) quickly and easily.

1 Claim, 7 Drawing Sheets

GOLF ALIGNMENT TRAINING AID

CROSS-REFERENCE TO RELATED APPLICATION

This patent application claims benefit to U.S. Provisional Patent Application No. 62/680,320, filed Jun. 4, 2018, which is hereby incorporated by reference in its entirety as part of the present disclosure.

FIELD OF THE INVENTION

The present invention relates broadly to a visual aid and more specifically to a golf training device that is configured to assist in the alignment of a golfer's feet and body with their intended target.

BACKGROUND OF THE INVENTION

Whether an individual is just beginning to learn the game of golf or has been playing for years, a common issue that arises is misalignment of the individual's feet. This is because many individuals struggle with aligning their feet with an intended target whether it be on a fairway or putting green. In general, golf training devices are known as well as various training aids such as alignment sticks and teaching techniques that are intended to get an individual to orientate their feet with respect to a target when setting up to hit a golf ball at the target. However, none of the existing teaching aids and/or techniques help to ensure the correct alignment of a golfer's feet continuously. This is because of the need to move and re-align one's feet prior to each swing of a golf club. For example, alignment sticks must be constantly physically moved and realigned with a target. The time it takes to move and adjust such a tool can cause an individual to lose focus and it can be cumbersome to move along with golf clubs, balls, etc.

SUMMARY OF THE INVENTION

The present disclosure is directed to a golf alignment training aid that assists an individual to properly orientate their feet in relation to an intended target. More specifically, the device is a visual directional aid that is attached to each shoe worn by an individual to visually assist the individual to physically align his/her feet with respect to an intended target (e.g., fairway, green, hole, etc.) quickly and easily.

Once the aid is attached to each shoe of the golfer's two shoes, the aid can stay attached thereto and thus, moves with the individual so as to not require constant setup prior to each swing of a golf club. This allows the individual to align their feet with an intended target quickly and easily prior to each swing of a golf club.

In an embodiment the present invention is directed to a golf training aid that comprises a main body delimited between a first end and a second end and including a first portion, a second portion extending from the first portion and a third portion extending from the second portion, the first portion including a width that is greater than the width of the second portion and the third portion, the second portion having a width that is greater than the third portion and the third portion, at the second end of the main body tapering to an apex with the third portion and the second portion configured to be insertable at one of between and behind laces of a shoe.

The main body can include a first projection and a second projection that are spaced from each other and extend substantially perpendicular to the main body. The projections can extend in a pair from the main body.

In an embodiment the present invention is directed to a method of directionally orientating feet of a golfer comprising the steps of: providing a first golf training aid and a second golf training aid that each include a main body delimited between a first end and a second end and including a first portion, a second portion extending from the first portion and a third portion extending from the second portion, the first portion including a width that is greater than the width of the second portion and the third portion, the second portion having a width that is greater than the third portion and the third portion, at the second end of the main body tapering to an apex; affixing the first golf training aid in a first direction to a first shoe worn on a first foot by the golfer; affixing the second golf training aid in the first direction to a second shoe worn on a second foot by the golfer; aligning the first foot and the second foot and in turn the first golf training aid and the second golf training aid with a desired target; and swinging a golf club and contacting a golf ball to direct the golf ball toward the desired target.

DETAILED DESCRIPTION OF EMBODIMENTS OF THE INVENTION

Figure 1:
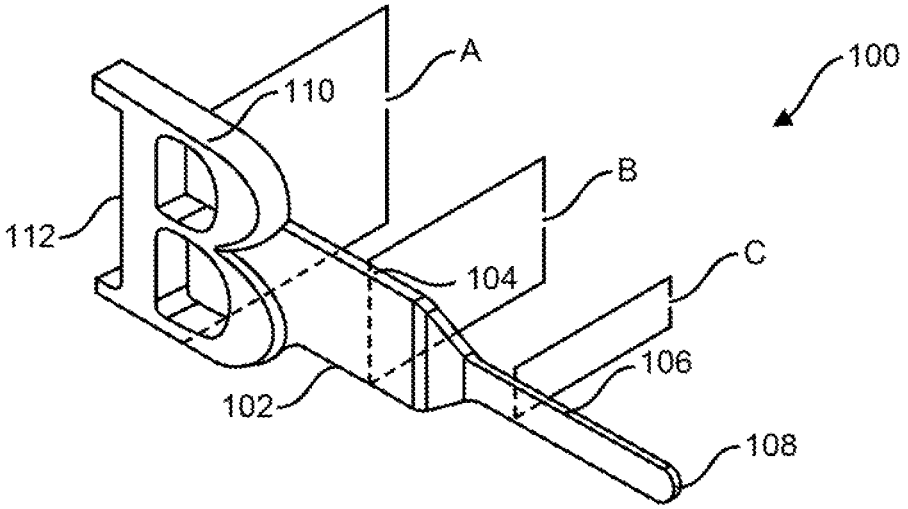
FIG. 1 is a perspective view of a golf alignment training aid according to an embodiment of the present disclosure.

With reference now to the drawings, and in particular to FIGS. 1 through 10, embodiments of a golf alignment training aid of the present disclosure, which are designated generally by reference numerals 100 and 200, respectively, will be described.

Proper alignment of a golfer's feet is critical to ensure the golf ball is struck and travels toward an intended target. For example, misalignment of the feet and body can cause the drive of a golf ball to be 10 to 50 yards offline of an intended target or a putt to be one to twelve inches offline of a hole.

The golf alignment training aid 100 is a visual directional aid that is attached to each of the shoes of an individual to visually assist the individual physically align his/her feet with respect to an intended target (e.g., fairway, green, hole, etc.) quickly and easily when an individual positions their body to putt, chip, pitch or fully swing a golf club. Once the aid 100 is attached to each shoe, the aid 100 can stay attached thereto and thus, moves with the individual so as to not require constant setup prior to each swing of a golf club.

Figure 2:
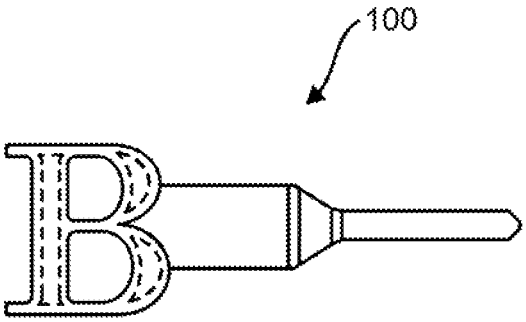
FIG. 2 is a front elevation view thereof.
Figure 3:
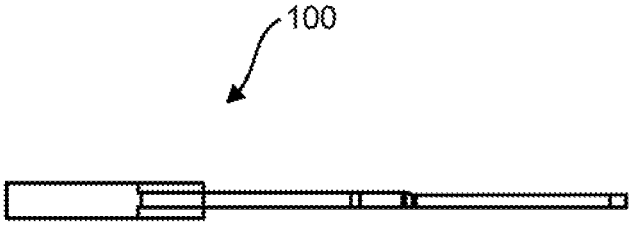
FIG. 3 is a top view thereof.
Figure 4:
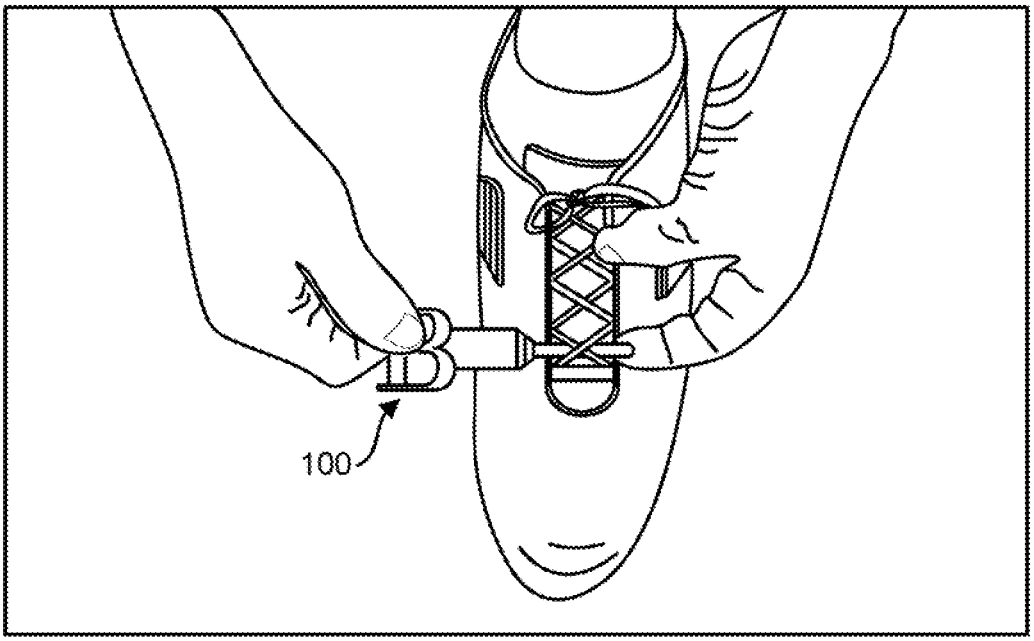
FIG. 4 shows the golf alignment training aid of FIG. 1 being inserted between shoelaces in a shoe according to an embodiment of the present disclosure.

FIGS. 1-3 illustrate the golf alignment training aid 100 that is designed to ensure the alignment of the feet of an individual with a desired target. As depicted, the training aid 100 includes a body 102 that has first or central portion 104, with a width B, a second portion with a width C 106 that extends at a first end thereof from the first portion 104 toward a first end 108 of the body and a third portion 110 with a width A that extends at a first end thereof from a first end of the first portion 104 toward a second end 112 of the body that together extend between and are delimited by the first end 108 and the second end 112 of the body. As shown, the central portion 104 tapers at the first end thereof toward the second portion 106 of the body 102 and the second portion tapers to a point with the apex of the tapering of the second portion being the first end 108 of the body. The third portion 110 with its width A is wider than the first and second portions 104, 106 at B and C, respectively, such that the eyes of an individual using the aid 100 are focused on the alignment of their feet (e.g., the aid 100 acts as a first arrow (first foot) and a second arrow (second foot) that are orientated in line with each other).

In an embodiment, the overall length of the body can be about 4½ inches, the first portion can be tapered about 33 degrees and the tapering of the second portion can be about 45 degrees.

The golf alignment training aid 100 can be comprised, for example, of a polymer such as plastic that can be produced by an injection molding process. Alternatively, the aid 100 can be comprised of a metal or alloy that is manufactured, for example, by punching or stamping.

Figure 5:
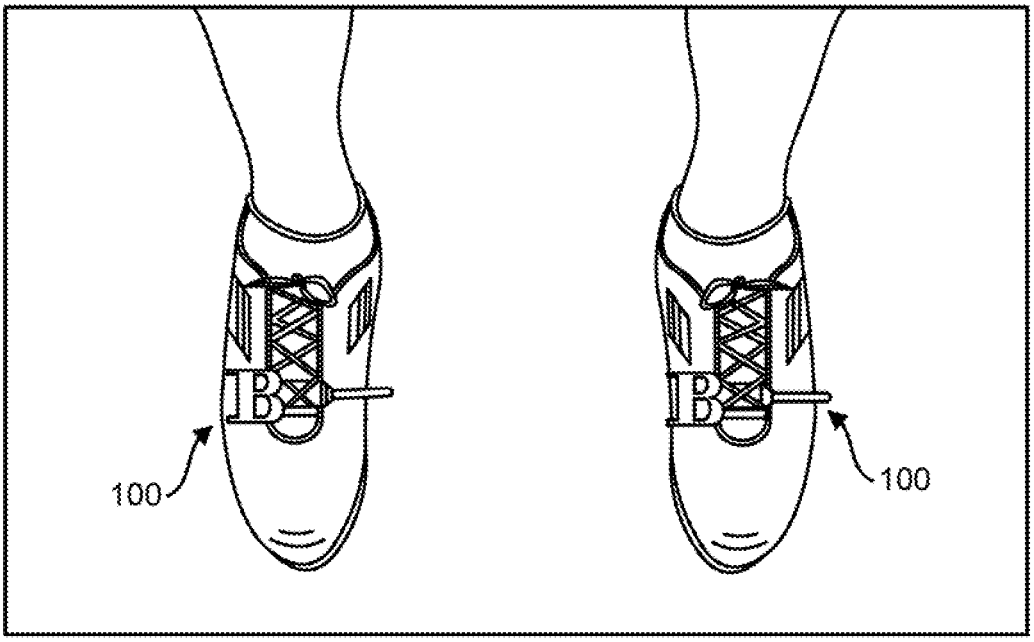
FIG. 5 shows the golf alignment training aid of FIG. 1 inserted between shoelaces in both a right shoe and a left shoe according to an embodiment of the present disclosure.

FIG. 5 illustrates the alignment training aid 100 being inserted in between shoelaces of a first shoe worn by an individual. As shown, the alignment training aid 100 is inserted such that the first end 108 extends under shoelaces and protrudes from the shoelaces in the direction of the individual's golf swing. To arrange the aid 100 underneath shoelaces, the laces can be loosened and to secure the aid 100 in place, the shoelaces can be tightened. Once arranged in relation to the shoe and shoelaces, the aid 100 is orientated approximately parallel to the ground. It is noted that although one only shoe and alignment training aid 100 is shown that a second, identical, training aid 100 can be inserted between the shoelaces of the second shoe worn by the individual in the same direction as the alignment training aid 100 arranged between the shoelaces of the first shoe. It should also be noted that although the aid 100 is depicted as being inserted between shoe laces that the aid can be attached to a shoe that may contain hook and loop fasteners to secure the shoe to am individual's foot as opposed or in addition to shoelaces.

Figure 6:
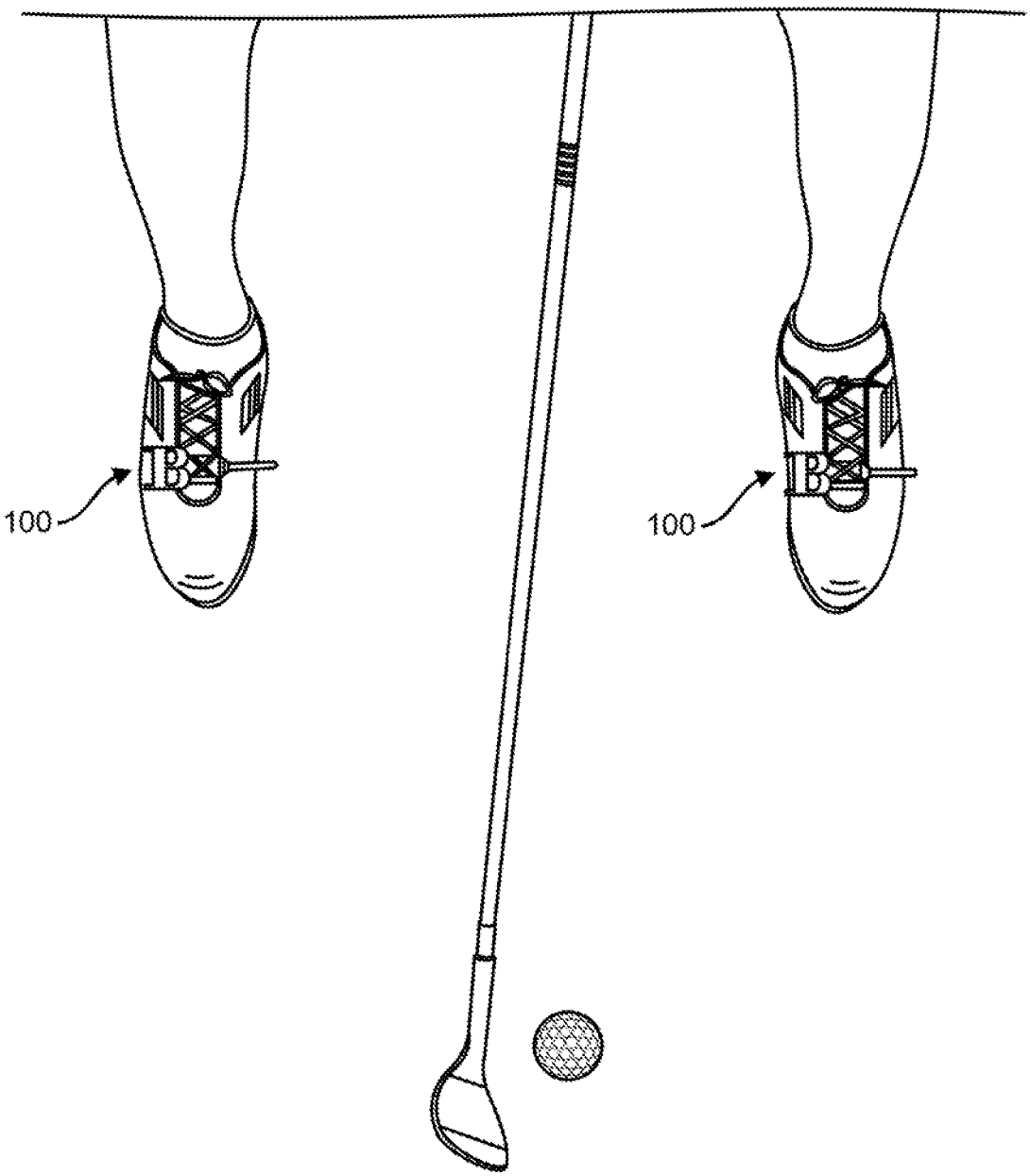
FIG. 6 shows the golf alignment training aid of FIG. 1 inserted between shoelaces in both a right shoe and a left shoe with an individual setting up to swing a golf club according to an embodiment of the present disclosure.

FIG. 6 depicts a right shoe and a left shoe that each include the alignment training aid 100 inserted in a same direction through the shoelaces thereof. As noted above, the direction in which the aid 100 is inserted in each shoe is the swing direction of an individual. Thus, as shown in FIG. 6, the swing direction of the user is from left to right. Prior to swinging a golf club, the user should align their feet such that the first end of each alignment training aid 100 faces the desired target.

Figure 7:
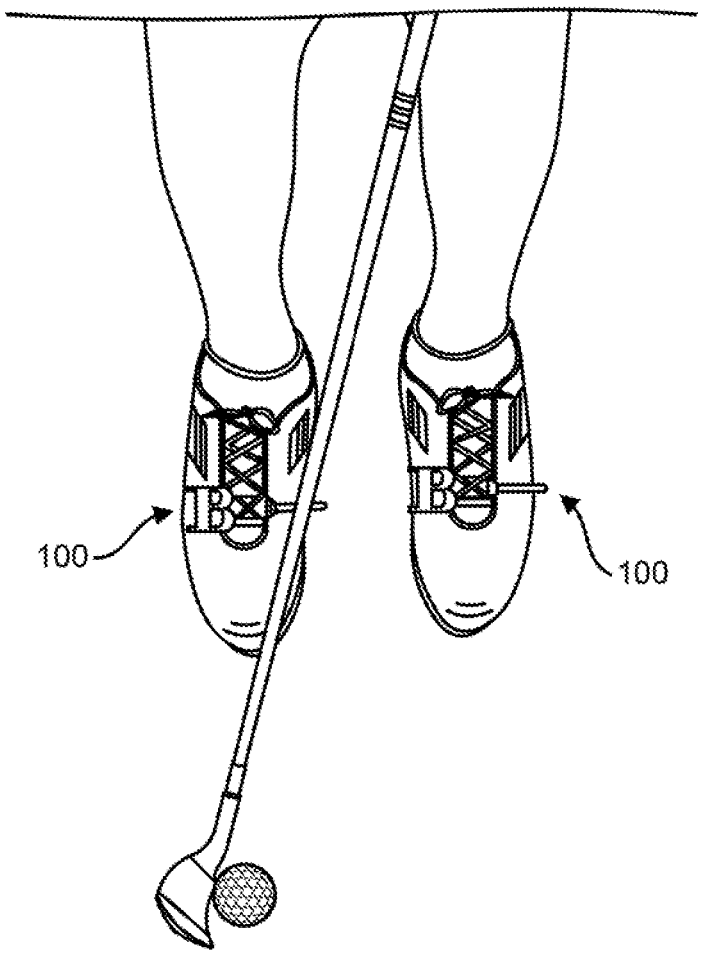
FIG. 7 shows the golf alignment training aid of FIG. 1 inserted between shoelaces in both a right shoe and a left shoe with an individual setting up to swing a golf club according to an embodiment of the present disclosure.
Figure 8:
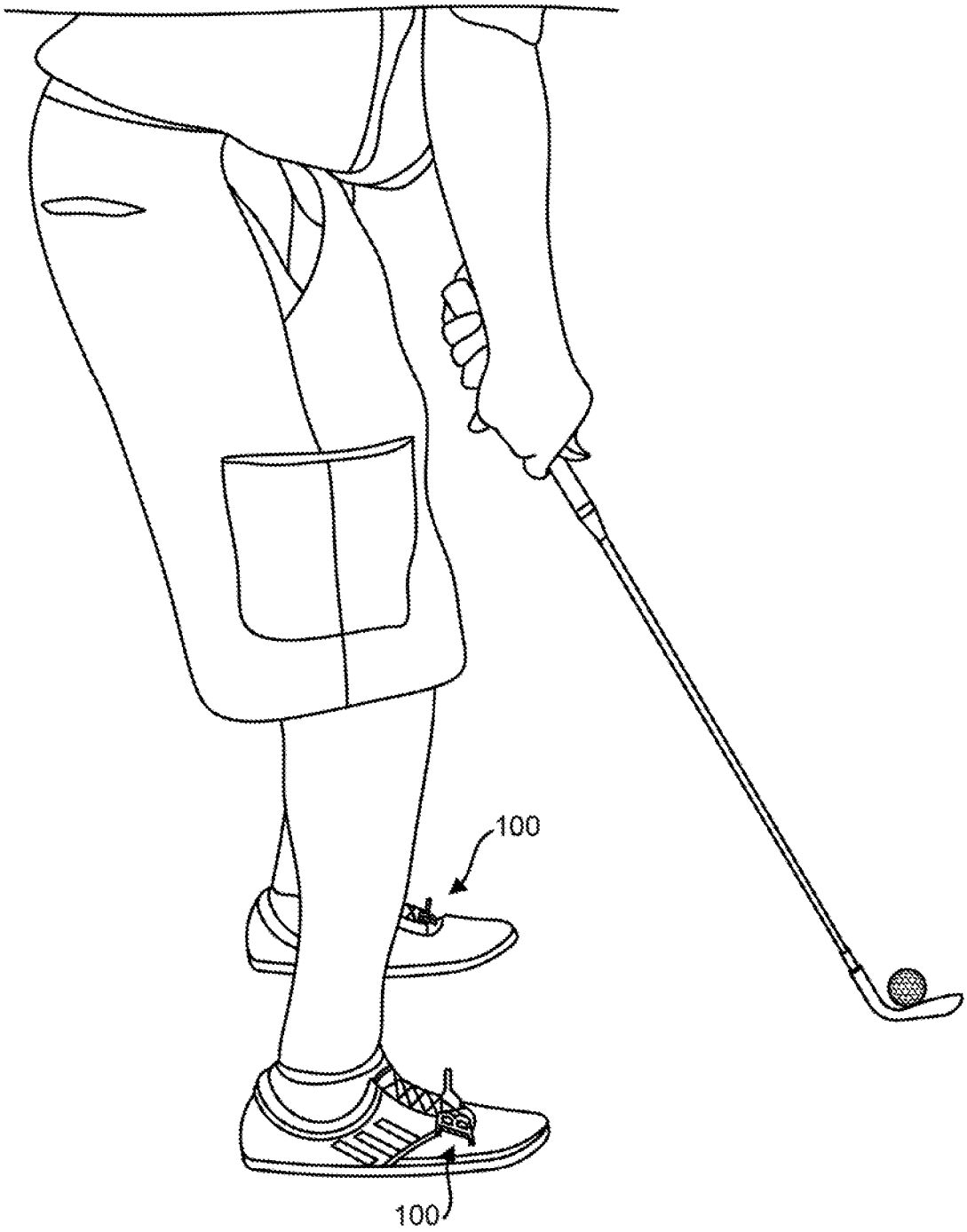
FIG. 8 shows the golf alignment training aid of FIG. 1 inserted between shoelaces in both a right shoe and a left shoe with an individual setting up to swing a golf club according to an embodiment of the present disclosure.
Figure 9:
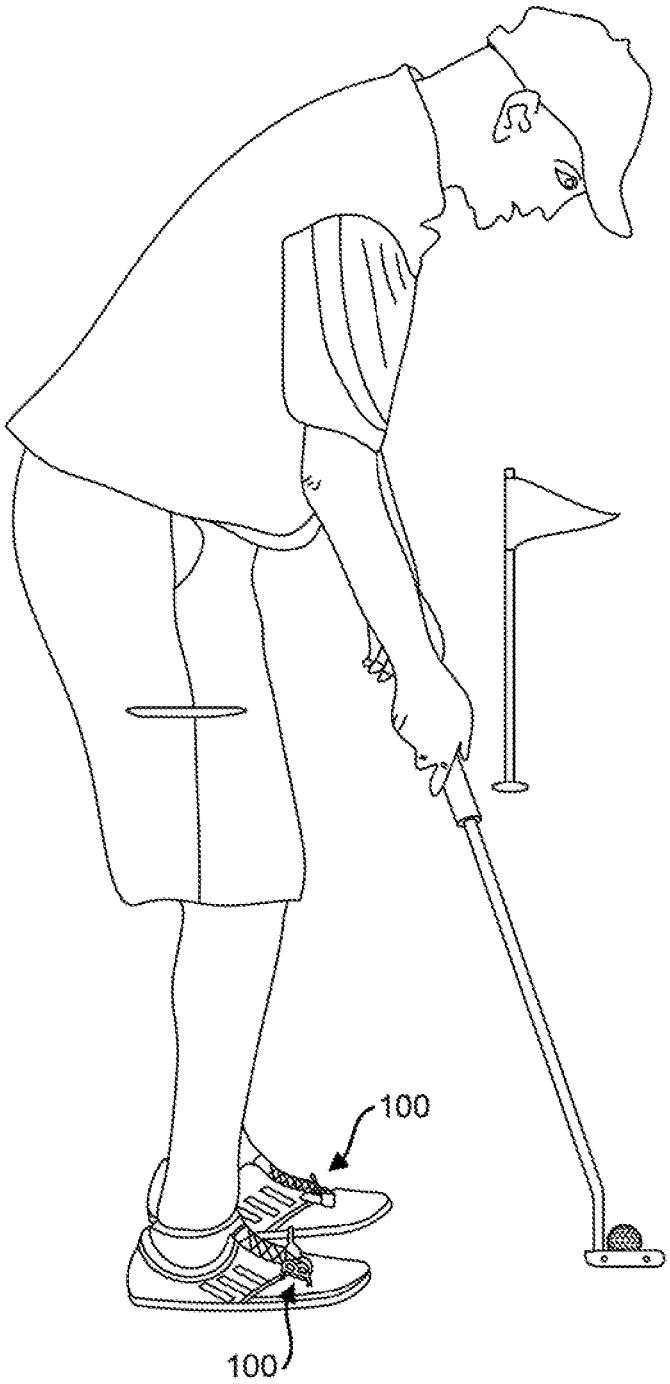
FIG. 9 shows the golf alignment training aid of FIG. 1 inserted between shoelaces in both a right shoe and a left shoe with an individual setting up to swing a golf club according to an embodiment of the present disclosure.

FIGS. 7-9 illustrate an individual holding a golf club and positioning their feet using the golf alignment training aid 100 so that the individual's feet are in line with an intended target such as a fairway, green or hole.

Figure 10:
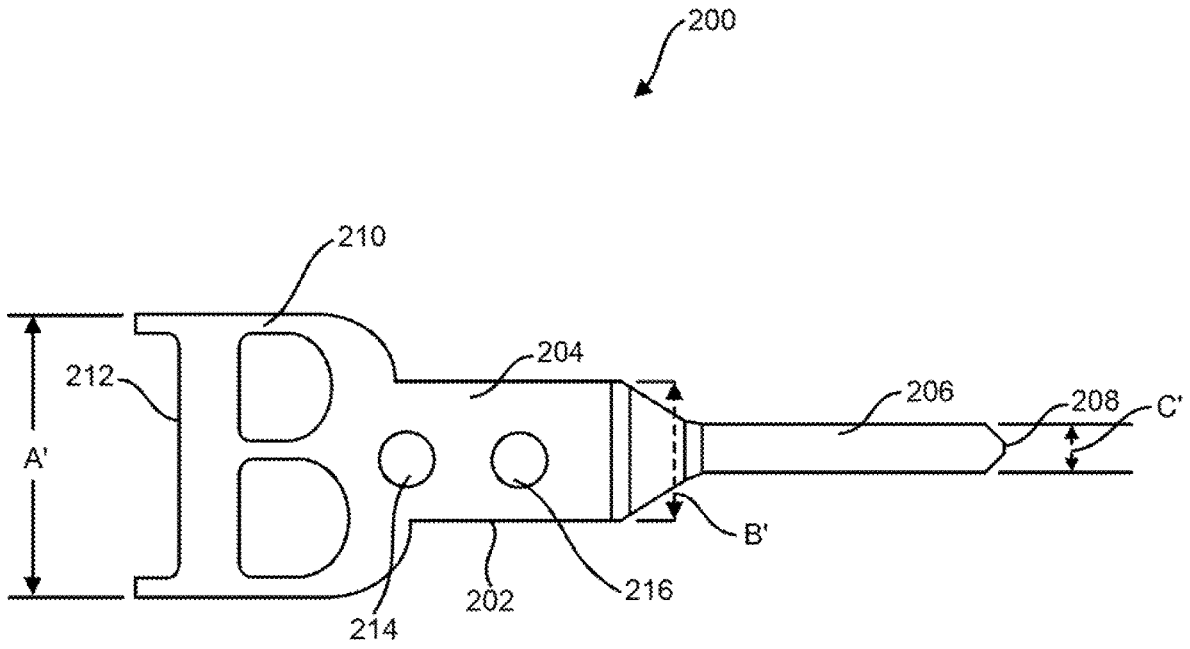
FIG. 10 is a front elevation view of a golf alignment training aid according to another embodiment of the present disclosure.

FIG. 10 illustrates another embodiment of a golf alignment training aid 200. The aid 200 includes many of the same structural features as training aid 100 described above. As such, like reference numbers will be used with reference to training aid 200.

As depicted, the training aid 200 includes a body 202 that has first or central portion 204, a second portion 206 that extends at a first end thereof from the first portion 204 toward a first end 208 of the body and a third portion 210 that extends at a first end thereof from a first end of the first portion 204 toward a second end 212 of the body that together extend between and are delimited by the first end 208 and the second end 212 of the body. As shown, the central portion 204 tapers at the first end thereof toward the second portion 206 of the body 202 and the second portion tapers to a point with the apex of the tapering of the second portion being the first end 208 of the body. The third portion 210 at A' is wider than the first and second portions 204, 206 B' and C', respectively, such that the eyes of an individual using the aid 200 are focused on the alignment of their feet (e.g., the aid 200 acts as a first arrow (first foot) and a second arrow (second foot) that are orientated in line with each other).

The first portion 204 of the aid 200 includes a first protrusion 214 and a second protrusion 216 that are configured to aid in securing the training aid 200 with respect to shoelaces of a shoe when worn. That is, the protrusions 214, 216 are designed to prevent lateral movement of the training aid 200 so that the aid does not easily become detached from the laces of a shoe. In an embodiment, the protrusions can be approximately 0.20 inches in diameter, can be spaced approximately 0.75 inches from each other and can include a rounded distal end (e.g., mushroom-like head).

The foregoing description and associated images illustrate several embodiments of the invention and its respective constituent parts. As such, the images are not intended to be limiting in that regard. Thus, although the description above and accompanying images contain much specificity, the details provided should not be construed as limiting the scope of the embodiments, but merely as providing illustrations of some of embodiments of the present disclosure. The images and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

What is claimed is:

1. A method of directionally orientating feet of a golfer comprising the steps of:

providing a first golf training aid and a second golf training aid that each include a main body delimited between a first end and a second end and including a first portion, a second portion extending from the first portion and a third portion extending from the second portion, the first portion including a width that is greater than the width of the second portion and the third portion, the second portion having a width that is greater than the third portion and the third portion, at the second end of the main body tapering to an apex;

affixing the first golf training aid in a first direction to a first shoe worn on a first foot by the golfer;

affixing the second golf training aid in the first direction to a second shoe worn on a second foot by the golfer;

aligning the first foot and the second foot and in turn the first golf training aid and the second golf training aid with a desired target; and swinging a golf club and contacting a golf ball to direct the golf ball toward the desired target.

* * * * *